US008932709B2

(12) United States Patent
Carter

(10) Patent No.: US 8,932,709 B2
(45) **Date of Patent: *Jan. 13, 2015**

(54) GROUND COVER FOR CONTAINMENT BARRIERS

(71) Applicant: Richard Carter, Tempe, AZ (US)

(72) Inventor: Richard Carter, Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,708

(22) Filed: Oct. 1, 2013

(65) Prior Publication Data

US 2014/0315017 A1 Oct. 23, 2014

Related U.S. Application Data

(63) Continuation of application No. 13/865,047, filed on Apr. 17, 2013.

(51) Int. Cl.
*E02D 3/00* (2006.01)
*E02D 31/00* (2006.01)

(52) U.S. Cl.
CPC ..... *E02D 31/004* (2013.01); *E02D 3/005* (2013.01)
USPC ..... 428/341; 405/302.7

(58) Field of Classification Search
None
See application file for complete search history.

(56) References Cited

U.S. PATENT DOCUMENTS 5,747,134 A * 5/1998 Mohammed et al. ..... 428/57
2007/0267128 A1* 11/2007 Horn et al. ..... 156/172

* cited by examiner

*Primary Examiner* — Callie Shosho
*Assistant Examiner* — Patrick English
(74) *Attorney, Agent, or Firm* — Robert A. Parsons; Michael W. Goltry; Parsons & Goltry

(57) ABSTRACT

A ground cover for use as a containment barrier including a geomembrane sheet and a geotextile sheet bonded together by an adhesive layer positioned therebetween. The adhesive layer does not fully cure, remains tacky and has an adhesive strength sufficient to maintain a bond between the geomembrane sheet and the geotextile sheet under normal foot traffic and a release point allowing separation of the geomembrane sheet and the geotextile sheet under shear forces generated by heavier traffic.

12 Claims, 2 Drawing Sheets

GROUND COVER FOR CONTAINMENT BARRIERS

FIELD OF THE INVENTION

This invention relates to containment barriers.

More particularly, the present invention relates to sheet materials covering the ground for use as containment barriers.

BACKGROUND OF THE INVENTION

In industries that have the potential to contaminate the environment, such as oil wells, gas wells, induced hydraulic fracturing sites, storage sites, mining operations, and the like, it is often desirous to provide a means to protect the environment from contamination, and reduce the cost and complexity of spill cleanup. At drilling sites, many potential contaminating fluids are used. Depending on the type of drilling being performed, various fluids can include drilling mud, fuels, fracturing chemicals, corrosives and flowback water. Spills of any of these liquids must be cleaned from the environment. If the soil at the drill site is contaminated, the contaminated soil must be remediated. To reduce the amount of contaminated soil and water and to eliminate regulatory fines, many operating companies excavate the site, cover it with stone or crushed rock, place a geotextile over the crushed rock, and then loosely place a geomembrane over the surface. A geotextile is typically a strong synthetic fabric used in civil engineering that stabilizes loose soil. Geotextiles are permeable fabrics which generally come in three basic forms: woven, needle punched, or heat bonded. The geotextile protects the geomembrane from sharp edges in the stone or crushed rock base. The geomembrane is non-permeable and contains the leaks and spills for subsequent removal, e.g., until an on-site vacuum truck can remove them without impact to the environment.

There are issues with this type of containment barrier. Traditional HDPE geomembranes for ponds and pits were not designed for foot and vehicle traffic. HPDE geomembranes are prone to punctures, e.g., from dropped hoses, vehicles and equipment movement. The geomembranes are also extremely slippery to work on, even with a textured surface. Friction treatment of geomembrane or geotextile surfaces to prevent slippage is disclosed in U.S. Pat. Nos. 5,056,960 and 5,137,393, respectively. To increase traction in standing water, snow and ice, some operating companies place, but do not bond, an additional layer of a geotextile over the HDPE geomembrane to reduce slip hazards. However, in this application, the geotextile slides on the geomembrane, producing a slip hazard and additionally, the geotextile is subject to wrinkling, bunching up or folding to produce trip hazards. The loose material can also be pulled into vacuum hoses while removing liquids from the surface. The loose geotextile can mask punctures in the geomembrane beneath it, which may only be discovered after a spill or leak.

A polymer sheet that has geotextiles affixed by mechanical engagement on both sides is disclosed in U.S. Pat. Pub. 2012/0219746. This structure affixes the layers by embedding a portion of the geomembrane into the geotextile to prevent separation. While this prevents movement between the layers, repairing damage in the containment liner can be difficult since the layers cannot be separated. The entire damaged portion must be replaced. Additionally, while the top layer of geotextile will protect the geomembrane from punctures and the like, the flexibility of the geotextile is greater than the geomembrane. Thus, when heavy vehicles or objects are moved across the surface and have a change in direction, shear forces on the liner can cause a tear in the geomembrane or can cause a tear in the geomembrane and the geotextile. This tear will prevent proper containment, is difficult to repair and may go unnoticed if the geotextile is not damaged.

It would be highly advantageous, therefore, to remedy the foregoing and other deficiencies inherent in the prior art.

An object of the present invention is to provide a ground cover for use as a containment barrier that will allow both foot and vehicle traffic.

SUMMARY OF THE INVENTION

Briefly, to achieve the desired objects and advantages of the instant invention provided is a ground cover for use as a containment barrier. The ground cloth includes a geomembrane sheet having a first surface and a second surface, a geotextile sheet having a surface overlying the first surface of the geomembrane sheet, and an adhesive layer positioned between the first surface of the geomembrane sheet and the surface of the geotextile sheet. The adhesive layer does not fully cure and remains tacky, the adhesive layer having an adhesive strength sufficient to maintain a bond between the geomembrane sheet and the geotextile sheet under normal foot traffic and a release point allowing separation of the geomembrane sheet and the geotextile sheet under shear forces generated by heavier traffic. The adhesive layer is present in an amount of .01 to less than .07 ounce per square foot of surface and is a pressure sensitive adhesive.

In a further aspect of the invention, the ground cover includes a second geotextile sheet having a surface overlying the second surface of the geomembrane sheet. A second adhesive layer is positioned between the second surface of the geomembrane sheet and the surface of the second geotextile sheet. This second adhesive layer may include an adhesive that does not fully cure and remains tacky. The second adhesive layer may have an adhesive strength sufficient to maintain a bond between the geomembrane sheet and the geotextile sheet under normal foot traffic and a release point allowing separation of the geomembrane sheet and the geotextile sheet under shear forces generated by heavier traffic.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
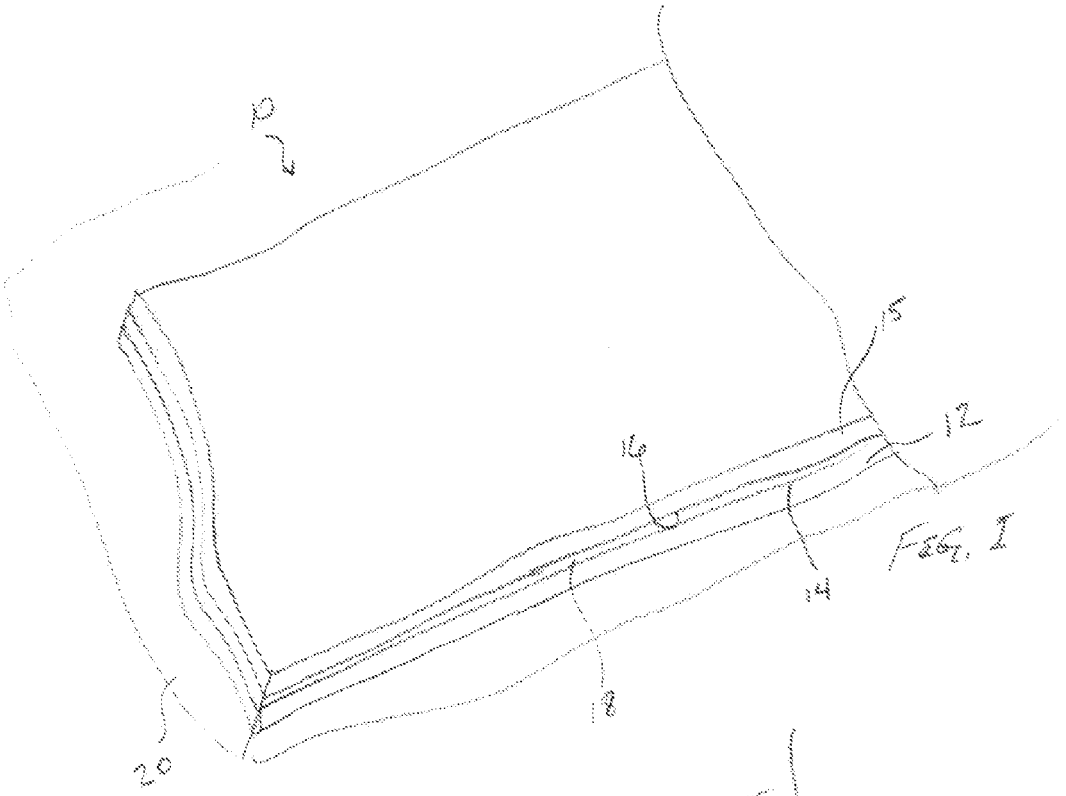
FIG. 1 is a sectional perspective view of a ground cover according to the present invention.

Turning now to the drawings in which like reference characters indicate corresponding elements throughout the several views, attention is first directed to FIG. 1 which illustrate a ground cover 10 according to the present invention. Ground cover 10 is intended to be employed as a containment barrier to prevent contaminants from reaching the soil. Ground cover 10 covers an area to be protected, and contains any spills occurring in the area until they can be cleaned, collected and removed. Ground cover 10 includes a geomembrane sheet 12 having a surface 14, a geotextile sheet 15 having a surface 16 overlying surface 14, and an adhesive layer 18 carried between surface 14 and surface 16. As will be described presently, the adhesion strength between geomembrane sheet 12 and geotextile sheet 15 is essential to the invention. Geomembrane sheet 12 is substantially any impermeable membrane (usually made of synthetic polymers in sheets) used with soils, rock, earth, or other geotechnical material in order to block the migration of fluids. In the present embodiment, geomembrane sheet 12 is a 24 mil or 30 mil woven coated polyethylene. Woven coated polyethylene products are high density polyethylene threads woven together to make a cloth. Then a low density polyethylene is coated over the "cloth" to make it water tight. It will be understood that there are a myriad of woven coated and film polymers which can be used as the geomembrane of the present invention. Geotextile sheet 15 is substantially any geotextile, but is, in this embodiment, a non-woven polypropylene (felt) material being approximately 8 oz per square yard.

Ground cover 10 is positioned on an area to be protected with geomembrane sheet 12 adjacent soil 20 and geotextile sheet 15 in an overlying relationship and presenting a secure footing upon which traffic can move and work can be performed. In this specific embodiment, geomembrane sheet 12 should be of sufficient thickness to prevent punctures and ripping by contact with the underlying soil 20. Adhesive layer 18 bonds the entire overlying area of surfaces 14 and surface 16 together, securely holding geomembrane sheet 12 and geotextile sheet 15 immobile relative one another under standard foot traffic. Adhesive later 18 employs an adhesive which does not fully cure, remaining "tacky" when ground cover 10 is deployed. The adhesive strength and the release point of the adhesive is vital to the invention. The adhesive strength is sufficient to securely bond geomembrane sheet 12 and geotextile sheet 15 together under normal foot traffic and light workloads, while having a release point allowing separation of geomembrane sheet 12 and geotextile sheet 15 under heavier shear loads resulting from heavy machinery or vehicles. To achieve this balance, it has been determined that a hot melt pressure sensitive adhesive such as that supplied by HB Fuller HL-2811 and HL-2081 can be used. These products function with a base ingredient of a synthetic rubber which produces the flexibility. This is augmented with hydrocarbon resins which produce the specific adhesion and tack of each formula. Hydrocarbon oil is also included to provide the permanent qualities of the pressure sensitivity. To achieve the desired adhesion and separation point, the adhesive is applied in an amount of .01 to less than .07 ounce per square foot of surface. In the preferred embodiment, with the preferred adhesive, approximately .017 ounce of adhesive is applied per square foot. The adhesive must be melted and applied prior to adhering geomembrane sheet 12 to geotextile sheet 15.

Figure 2:
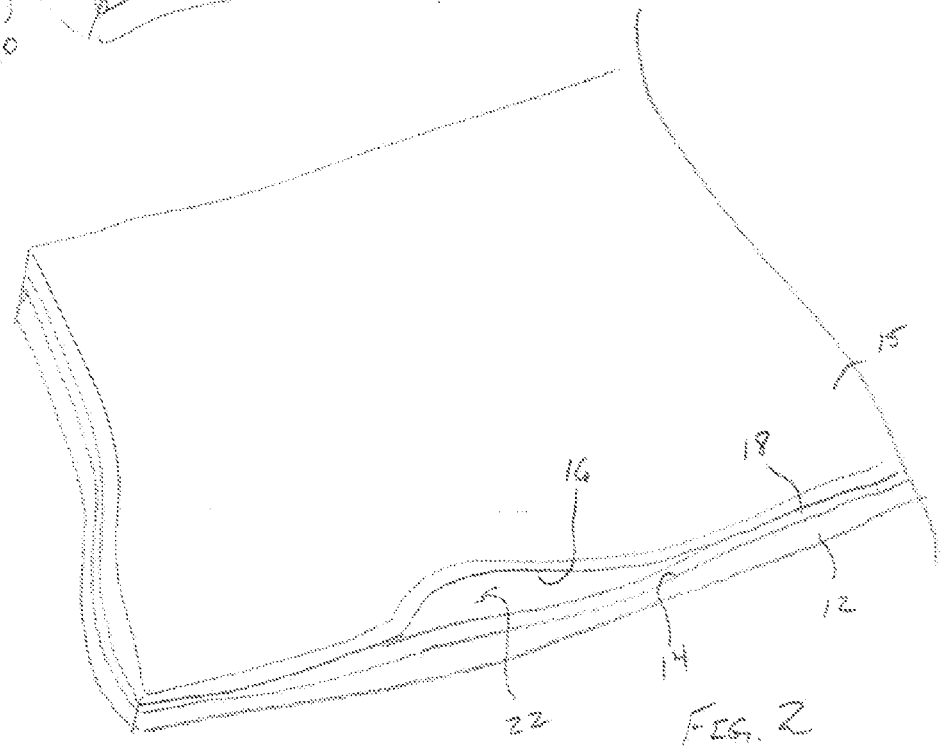
FIG. 2 is a sectional perspective view of the ground cover of FIG. 1 showing a separation.

In this manner, workers and other individuals can work and move about upon ground cover 10 without being subject to slipping or tripping hazards. Geomembrane sheet 12 is protected from damage by foot traffic and dropped tools and the like as well as protected from damage by heavy equipment such as vehicles and the like by geotextile layer 15. Additionally, pinching or tearing of geomembrane layer 12 resulting from shear forces exerted on geotextile sheet 15 by heavy machinery and vehicles is prevented by an intentional separation 22 (FIG. 2) of geotextile sheet 15 from geomembrane sheet 12 in the area of shear force application. In other words, if for example, a moving tire is turned on ground cover 10, shear forces generated by the turning tire would normally cause a tear or pinch in geomembrane sheet 12. By permitting geotextile sheet 15 to separate from geomembrane 12 in this area, the shear forces will be dissipated in the geotextile sheet 15, leaving the geomembrane sheet 12 undamaged. Once the shear force has been removed, the portion of geotextile sheet 15 separated from geomembrane sheet 12 will return to a normal position, and will re-adhere to geomembrane sheet 12. It will be understood that while ground cover 10 has been described with geomembrane sheet 12 adjacent soil 20, ground cover 10 can be inverted if desired, with geotextile sheet 15 adjacent soil 20.

Figure 3:
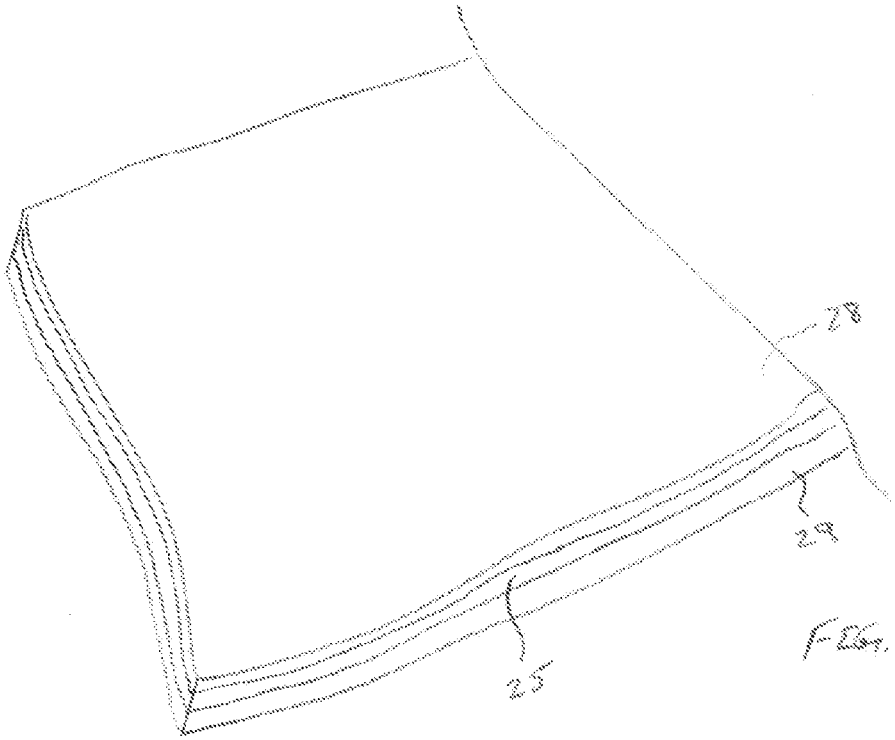
FIG. 3 is a sectional perspective view illustrating an adhesive repair layer.

Ground cover 10 can also be easily repaired by cutting out a damaged or contaminated portion of geotextile sheet 15 and peeling it from the geomembrane sheet 12. If there is insufficient adhesive from adhesive layer 18 remaining, additional adhesive can be applied as necessary and a replacement portion of geotextile adhered into position on geomembrane sheet 12. Additional adhesive can be applied by providing an adhesive repair layer 25. Referring to FIG. 3, adhesive repair layer 25 is provided by depositing the adhesive, such as by spraying, between specially coated papers 28, 29, such as "wax paper". When a contaminated or damaged section of geotextile sheet 15 must be replaced, the section is cut out, one of the coated papers 28 is removed, the adhesive repair layer 25 on the remaining paper 29 is adhered to a replacement section of geotextile and the remaining paper 29 peeled away leaving adhesive repair layer 25 affixed to the replacement section. The replacement geotextile section can then be adhered to exposed geomembrane sheet 12. In this manner, repairs to ground cover 10 can be undergone without the need for a hot glue gun in the field.

It will also be understood that large areas may need to be covered by ground cover 10. If the area is larger than can be efficiently handles with one section of ground cover 10, multiple section of ground cover 10 may need to be positioned adjacent one another and sealed together. To accomplish this, a strip of geotextile sheet 15 can be removed from the adjacent edges of the sections and the geomembrane sheets 12 heat bonded together to form a leak proof seal. Any exposed geomembrane can be covered by geotextile 15 using the above described repair technique.

Figure 4:
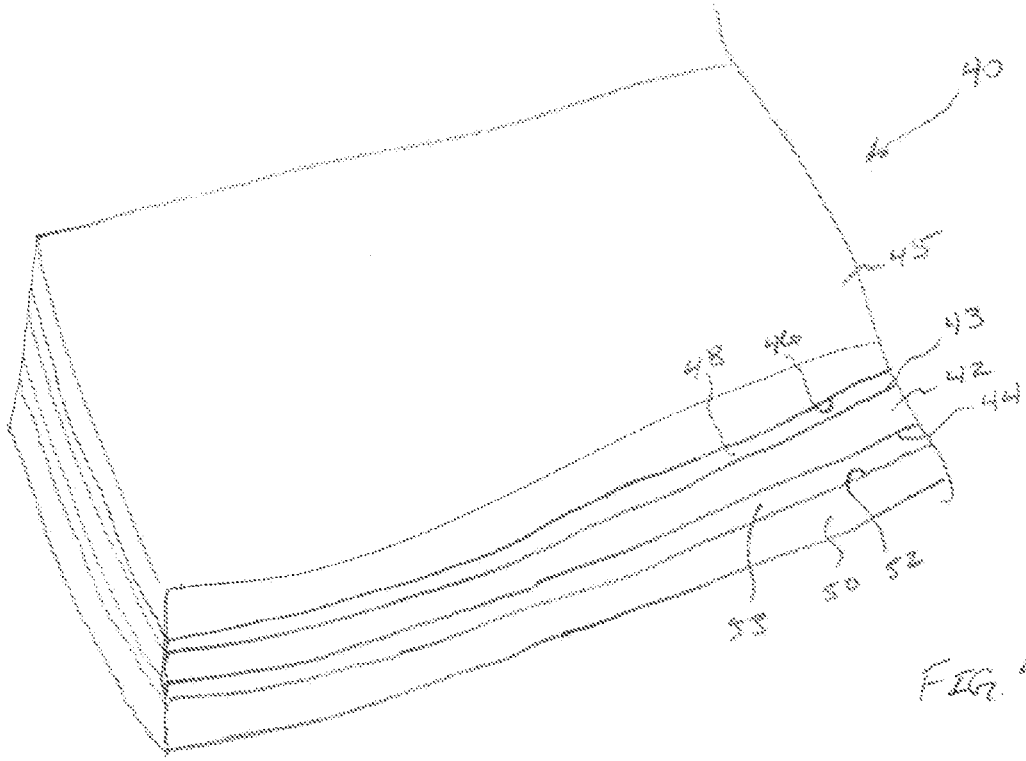
FIG. 4 is a sectional perspective view of another ground cover according to the present invention.

Turning now to FIG. 4, it can be seen that multiple layers of material can be employed in a ground cover generally designated 40. Ground cover 40 includes includes a geomembrane sheet 42 having opposing surfaces 43 and 44, a geotextile sheet 45 having a surface 46 overlying surface 43, an adhesive layer 48 carried between surface 43 and surface 46, another geotextile sheet 50 having a surface 52 overlying surface 44, and an adhesive layer 53 carried between surface 44 and surface 52. As described previously, the adhesion strength between geomembrane sheet 42 and geotextile sheets 45 and 50 is essential to the invention. By sandwiching geomembrane sheet 42 between geotextile sheets 45 and 50, geomembrane sheet 42 is offered better protection.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A ground cover for use as a containment barrier comprising:

a geomembrane sheet, which is non-permeable and contains leaks and spills for subsequent removal, having a first surface and a second surface;

a geotextile sheet, which is a synthetic, permeable fabric, having a surface overlying the first surface of the geomembrane sheet; and an adhesive layer positioned between the first surface of the geomembrane sheet and the surface of the geotextile sheet, the adhesive layer is present in an amount of .01 to less than .07 ounce per square foot of surface, wherein the adhesive layer does not fully cure and remains tacky, the adhesive layer having an adhesive strength sufficient to maintain a bond between the geomembrane sheet and the geotextile sheet under foot traffic and having a release point allowing separation of the geomembrane sheet and the geotextile sheet under shear forces generated by vehicular traffic.

2. The ground cover as claimed in claim 1 wherein the adhesive layer is present in the amount of approximately .017 ounce per square foot.

3. The ground cover as claimed in claim 1 wherein the adhesive layer is a pressure sensitive adhesive.

4. The ground cover as claimed in claim 1 further including a second geotextile sheet having a surface overlying the second surface of the geomembrane sheet.

5. The ground cover as claimed in claim 4 further including a second adhesive layer positioned between the second surface of the geomembrane sheet and the surface of the second geotextile sheet.

6. The ground cover as claimed in claim 5 wherein the second adhesive layer does not fully cure and remains tacky, the second adhesive layer having an adhesive strength sufficient to maintain a bond between the geomembrane sheet and the geotextile sheet under normal foot traffic and a release point allowing separation of the geomembrane sheet and the geotextile sheet under shear forces generated by heavier traffic.

7. The ground cover as claimed in claim 6 wherein the second adhesive layer is present in the amount of approximately .017 ounce per square foot.

8. A ground cover for use as a containment barrier comprising:

a geomembrane sheet, which is non-permeable and contains leaks and spills for subsequent removal, having a first surface and a second surface;

a first geotextile sheet, which is a synthetic, permeable fabric, having a surface overlying the first surface of the geomembrane sheet;

a second geotextile sheet, which is a synthetic, permeable fabric, having a surface overlying the second surface of the geomembrane sheet;

a first adhesive layer positioned between the first surface of the geomembrane sheet and the surface of the first geotextile sheet, the adhesive layer is present in an amount of .01 to less than .07 ounce per square foot of surface, wherein the adhesive layer does not fully cure and remains tacky, the adhesive layer having an adhesive strength sufficient to maintain a bond between the geomembrane sheet and the first geotextile sheet under foot traffic and having a release point allowing separation of the geomembrane sheet and the first geotextile sheet under shear forces generated by vehicular traffic; and a second adhesive layer positioned between the second surface of the geomembrane sheet and the surface of the second geotextile sheet.

9. The ground cover as claimed in claim 8 wherein the first adhesive layer is present in the amount of approximately .017 ounce per square foot.

10. The ground cover as claimed in claim 8 wherein the second adhesive layer does not fully cure and remains tacky, the second adhesive layer having an adhesive strength sufficient to maintain a bond between the geomembrane sheet and the second geotextile sheet under normal foot traffic and a release point allowing separation of the geomembrane sheet and the second geotextile sheet under shear forces generated by heavier traffic.

11. The ground cover as claimed in claim 10 wherein the second adhesive layer is present in an amount of .01 to less than .07 ounce per square foot of surface.

12. The ground cover as claimed in claim 10 wherein the second adhesive layer is present in the amount of approximately .017 ounce per square foot.

* * * * *